United States Patent [19]

Shaw

[11] 4,091,130

[45] May 23, 1978

[54] METHOD FOR OBTAINING CONTROLLED CURE IN THE COATING OF PAPERS

[75] Inventor: Michael J. Shaw, Kalamazoo, Mich.

[73] Assignee: Allied Paper Incorporated, Kalamazoo, Mich.

[21] Appl. No.: 698,466

[22] Filed: Jun. 21, 1976

[51] Int. Cl.[2] ..... B41M 5/22; D06M 13/14

[52] U.S. Cl. ..... 427/358; 427/365; 427/369; 427/391

[58] Field of Search ..... 427/365, 358, 369, 391

[56] References Cited

U.S. PATENT DOCUMENTS

| | | | |
|---|---|---|---|
| 3,630,835 | 12/1971 | Busch | 427/391 X |
| 3,632,296 | 1/1972 | Pandell et al. | 8/128 R |
| 3,632,378 | 1/1972 | Busch | 427/365 X |
| 3,897,578 | 7/1975 | Kahda et al. | 427/369 X |

*Primary Examiner*—Michael R. Lusignan
*Attorney, Agent, or Firm*—Richard H. Thomas

[57] ABSTRACT

In a method for providing a cured coating on paper in which a coating formulation comprising a reactive polymer, a cross-linking agent, and a curing accelerator acid is applied to the paper, dried and calendered, the improvement for obtaining a controlled cure comprising encapsulating either or both the accelerator acid and cross-linking agent in microcapsules capable of rupture in the calendering step.

16 Claims, No Drawings

METHOD FOR OBTAINING CONTROLLED CURE IN THE COATING OF PAPERS

The present invention relates to providing a cured coating on paper, and in particular to a novel means for obtaining controlled cure in the coating operation.

BACKGROUND OF THE INVENTION

Many papers following forming and drying are subjected to functional coating. The present invention is applicable to all such coating operations, including the forming of barrier or pigment coats and top coats.

Most coatings are applied to the base paper in the form of water suspensions, although organic solvents or carriers can also be employed. After application, the coating is dried and then usually is calendered to smooth the surface, control surface texture, and develop a glossy finish. In the calendering operation, the paper is passed successively through the nips of a stack of as many as 12 or more hard steel or alternating hard steel and soft rolls.

Typical adhesives or binding agents for pigment and other cured coatings include casein, soy or alpha protein, starch, various modified rubber latices and other emulsions such as styrene-butadiene latex, emulsions based on acrylics and polyvinyl acetate.

Historically, these coatings have often been cured with aldehydes and aldehyde amine resins. Depending upon the heat and formulas, varying and often low degrees of cure are initially obtained. Several methods are available to speed up cure, such as using a catalyst. This, however, has the effect of reducing pot life, causing many production problems. It is possible to use higher levels of curing agents, but this often adversely affects other physical properties of the coating or paper product. Another method employed is the use of heat to promote a cure.

The use of acids to catalyze the action of the curing agent is well known. In the paper industry, such acid catalysts are often employed by installing water boxes on the calender stacks to add a small amount of the dilute acid to the already coated paper. This causes a full cure very quickly, without which the treatment could take weeks.

However, not all coating machines have such water boxes. It is an object of the present invention to provide a means for obtaining a rapid and controlled cure of applied coatings in a novel and facile manner.

Prior U.S. Pat. No. 3,632,296, assigned to Cluett, Peabody & Co., Inc., relates to a method for imparting durable press characteristics to textile fabrics containing some reactive fibers (e.g., cellulosic) in which resins or other cross-linking agents are applied to the fabric, optionally in the presence of a catalyst, and the fabric is heated to a temperature at which cross-linking of the reactive fibers occurs. A delayed cure is obtained by encapsulating the cross-linking material and/or catalyst in microcapsules. On the application of heat or pressure to the sensitized fabric, the encapsulated material is released to obtain curing. The method of this patent is limited to the treatment of fabrics. Also, controlling the rate of cure is not an aspect of this patent.

SUMMARY OF THE INVENTION

The present invention relates to improvements in a method for coating paper with a coating formulation which comprises a reactive polymer, having reactive carboxyl, hydroxyl or amido groups, an aminoplast cross-linking agent and a curing accelerator catalyst, wherein the coating formulation is applied to the paper, dried and calendered. The improvement comprises obtaining a controlled cure by encapsulating either the accelerator catalyst or cross-linking agent, or both, in microcapsules. The pressure applied to the paper in the calendering step is sufficient to cause rupture of the microcapsules thereby releasing the coating component or components encapsulated. Thus by the present invention, rapid cure is controlled in a manner similar to the use of water boxes heretofore employed. The present invention is applicable to the application to paper of all coatings, including pigmented coatings, barrier coatings and top coatings.

In addition to providing a controlled cure, the present invention offers the advantage of greater versatility in the coating step with regard to formulations, conditions of coating and application. For instance, the present invention permits the use of a wider class of aminoplasts than heretofore available, for instance those in which the pot life is too short or which are too viscous for use in conventional application equipment.

BRIEF DESCRIPTION OF THE INVENTION

Polymer compositions useful in the process of the present invention include water or solvent dispersible or soluble polymeric binders having one or more reactive sites, primarily carboxyl groups, hydroxyl groups, amido groups or mixtures of the same, capable of cross-linking with an aminoplast resin. These can be natural or synthetic polymers inherently containing such functionality, or hydrocarbon polymers modified to contain such functionality. Typical of the film-forming polymers used in paper coatings are casein, soy or alpha protein, starch, polyvinyl alcohol, alcohol or carboxylic acid functional polyesters (e.g., the ethylene glycol/-maleic/phthalate styrene type and glycerol phthalate type including those known as alkyds); epoxide resins (e.g., diglycidyl ethers of bisphenol A and its homologs); and acrylic or methacrylic acid resins.

The acrylic resins suitable for the present purposes include those resinous film-forming polymers (the term "polymers" as used herein includes homopolymers, copolymers, terpolymers, etc.) containing carboxylic acid functionality.

Compositionally, the acrylic acid resins can be an addition polymer of acrylic acid and any vinyl monomer or monomers copolymerizable therewith. Suitable vinyl monomers for polymerization with acrylic acid to form the acrylic polymers include acyclic esters such as methyl acrylate, butyl acrylate, methyl methacrylate, 2-ethyl-hexyl-acrylate, hydroxypropyl methacrylate, ethyl acrylate and the like; aromatic monomers such as styrene and vinyl toluene; vinyl chloride; ethylene; vinylidene chloride; and lower alkyl ($C_1$–$C_4$) substituted acrylic monomers (i.e., those having carboxyl groups contributed by alpha, beta-unsaturated carboxylic acids or residues thereof, etc.).

These resinous, film-forming, acrylic polymers are water solubilized by neutralization or partial neutralization with a water soluble, volatile, amino base such as ammonia, hydroxyl amines, polyamines and monoamines such as monoethanolamine. Typical amino bases include hydroxy amines, polyamines and monoamines such as: monoethanolamine, diethanolamine, triethanolamine, N-methyl ethanolamine, N-aminoethylethanolamine, N-methyl diethanolamine, monoisopropanolamine, diisopropanolamine, triisopropanolamine, "polyglycol amines" such as $HO(C_2H_4O)_2C_3H_6NH_2$, hydroxylamine, butanolamine, hexanolamine, methyldiethanolamine, octanolamine, and alkylene oxide reaction products of mono- and polyamines such as the reaction product of ethylene diamine with ethylene oxide or propylene oxide, laurylamine with ethylene oxide, etc.; ethylene diamine, diethylene triamine, triethylene tetramine, hexamethylene tetramine, tetraethylene pentamine, propylene diamine, 1,3 diaminopropane, imino-bis-propyl amine, and the like; and mono-, di- and tri-lower alkyl ($C_{1-8}$) amines such as mono-, di- and triethyl amine.

Representative hydrocarbon polymers modified to contain a carboxyl or other functionality are synthetic polymers in latex form such as acrylonitrile-butadiene copolymers copolymerized to contain the vinyl alcohol or acrylic moities; modified styrene-butadiene copolymers copolymerized with a monomer such as acrylic acid to provide acid functionality; vinyl and vinylidene polymers and polyvinyl acetate, also copolymerized with a monomer such as acrylic acid.

Particular resins which can be employed in the present invention are carboxylated 80/20 styrene-butadiene latex available as "Dow 636" or "Dow 620" from Dow Chemical Company; and acrylic latex containing 1–4% acrylic acid available as "B-15" and "B-60-A" from Rohn & Haas.

A particularly preferred resin for a coating used in offset publication paper is a styrene-butadiene latex modified to include carboxyl groups and sold under the trademark "General Tire 5071". Another for a solvent and water resistant barrier coating is the "Dow 620".

Water-dispersible aminoplast resins cross-linkable with the aforementioned polymers are heat reactive condensation products of amines, especially triazines with an aldehyde, such as formaldehyde. Condensation products of urea, melamine, annaline, ammeline, guanidine, dicyandiamidine, benzoguanamine with aldehydes such as formaldehyde, acrolein and butryaldehyde are typical aminoplast resins of which the benzoguanamine-formaldehyde resins are preferred. Such types include conventional aminoplasts made with substituted as well as straight benzoguanamine, melamine and urea and other aldehydes than formaldehydes. The condensation reaction product can be further etherified by reacting the methylol groups in part or in whole with alcohols such as butyl alcohol, methyl alcohol and propyl alcohol to achieve specific product properties. Further, aminoplast resins also include products obtained by addition polymerization with ethylenically unsaturated monomers having active amino groups in the molecules such as acrylamide or with other unsaturated monomers such as styrene, divinyl benzene, methacrylic acid and by addition of aldehyde to its amino group to form a methylol group and products obtained by etherifying the methanol groups as above described with alcohols.

Most of these useful cross-linkers have some measure of hydroxyl functionality which renders them water dispersible, and often soluble in water to give a clear solution. Useful aminoplast resins include "XM 1125", "XM 1123", "XM 1116", and "Parez 707", sold by American Cyanamid Company; and "Bakelite CKR-5254" and "CKR-0405" produced by Union Carbide Corporation.

A typical benzoguanamine resin for use in the present invention is made by reacting benzoguanamine and formaldehyde in the ratio of 1 mol of benzoguanamine per 3 moles of formaldehyde and alkylated with an alkanol, for instance 3 moles of butanol. A typical melamine resin for use in the present invention is made by reacting melamine and formaldehyde in the ratio 1 to 6 moles of the aldehyde per mol of melamine, then alkylating with 3 to 6 moles methanol or other alkanols. A typical urea resin for use in the present invention is made by reacting urea and formaldehyde in the ratio 1 to 2 moles of the aldehyde per mol of urea.

The curing accelerator acid preferably is one whose pKa in water at 20° C. is not substantially above about 1 and generally between about 0 and about 1. If more than one hydrogen is available on such acid, the first pKa is the governing one concerned here. If the pKa of the curing accelerator acid is substantially in excess of 1, the cure is usually impractically slow and too much curing accelerator acid needs to be used in the bath and codeposited with the polymer film. If insufficient amounts of the curing accelerator are used, surface strength and loss of water resistance may occur. On the other hand, if too much curing accelerator acid is incorporated in the formulation and transfers into the film, the excess acid present will interfere with coating performance and in the case of paper products attack the fibrous sheet.

The generally preferred curing accelerator acids are organic acids such as sulfonic acids (including sulfonates). Suitable curing accelerator acids include the acids of alkyl sulfonates, aryl sulfonates, alkyl sulfates, aryl sulfates, their respective salts, sulfonic and sulfated fatty esters, sulfonated and sulfated oils and fatty acids, alcohol sulfates, benzene, xylene and toluene sulfonates, naphthalene sulfates, dodecyl and tridecyl benzene sulfonates and petroleum sulfonates, sulfonic acids, for example, paratoluene sulfonic acid, dodecyl benzene sulfonic acid, benzosulfonic acid, naphthalenesulfonic acid, picric acid, trichloroacetic acid, trifluoroacetic acid and phenyl-sulfonic acid.

Inorganic catalysts other than acid catalysts, known to those skilled in the art, can also be employed in accordance with the concepts of the present invention. For instance, zinc chloride is a known inorganic catalyst in cross-linking of an aminoplast and carboxylated polymer.

It is understood that the encapsulated acids and/or cross-linkers may be used in solvent based coatings as well as aqueous based coatings.

The particular amount of the binder in the coating formulation, pigmented or otherwise, is not critical and can vary from 1–30% depending upon application. Also, the ratio of binder to water or solvent is not critical except that enough water or solvent should be used to disperse the binder. The resins can be dispersed in water or solvent to the extent of about 35% by weight to form a stable aqueous or solvent based dispersion. Similar resins which are water or solvent soluble to the extent of about 25% and below in water at 80° F. are also useful in the present invention.

The amount of aminoplast can vary widely, for instance from about 1:50 to about 1:2 based on the weight of reactive polymer. Advantageously, the ratio of aminoplast to reactive polymer is between about 1:10 and about 1:4. Optimum ratios are dependent upon the function of the coating.

The amount of accelerator acid can also vary, for instance in the range of about 0.1–3% based on the weight of reactive polymer, although for most applications, an amount in the range of about 0.5 to about 1% should suffice.

Typical pigment-containing formulations for a web offset paper coating are:

| | Broad Range | Pfd. Range |
|---|---|---|
| Reactive polymer based on Pigment | 5%–50% | 10%–25% |
| Aminoplast based on Polymer | 2%–20% | 5%–10% |
| Accelerator Acid based on Aminoplast | .1%–10% | .2%–2% |

These ranges can, of course, vary depending upon application. For a coated printing paper, a typical pigment-containing formulation would be 14% binder based on pigment, 5% aminoplast based on binder, and 0.25% encapsulated accelerator based on aminoplast. For a barrier coating or pigment coating, a typical formulation comprises 30% binder based on pigment, 10% aminoplast based on binder and 1% encapsulated accelerator acid based on aminoplast.

A particularly preferred system in accordance with the present invention is a formulation in which the reactive polymer is a compound selected from the group consisting of starch, protein, casein and synthetic carboxylated polymers, said cross-linking agent being an aldehyde or an aldehyde amine resin and the catalyst being an acid catalyst. Preferably, the coating components are water soluble or dispersible.

In the forming of the microcapsules, for encapsulating either the cross-linking agent or the catalyst, a wide variety of procedures are available and known to those skilled in the art. For instance, recently issued U.S. Pat. No. 3,886,084, Vassiliades, describes a method for forming microcapsules in the absence of coacervation. The disclosure of this patent is incorporated by reference herein. The only criteria, in the case of a water soluble accelerating agent or catalyst, such as a water soluble acid, is that the capsule be water impermeable. Alternatively, in the case of solid or oil accelerators, it is necessary that the capsule be both oil and water impermeable, when the resin is dispersed in a water medium. Thus, it is necessary that the microcapsules be impermeable or insensitive to the medium, if any, employed in the dispersing of the resin, aminoplast and accelerator components.

Alternatively, the minute capsules can be prepared by a method referred to as coacervation, described in a large number of prior patents. For example, the minute capsules may be formed by a film-forming polymeric material of a hydrophilic nature or character such as gelatin; or they may be formed of a film-forming polymeric material of a hydrophobic nature such as polyvinyl chloride. Other hydrophilic polymeric materials are gelatin, gum arabic, methyl cellulose, starch, alginate, polyvinyl alcohol, casein, agar-agar and the like. It is also possible to employ as the encapsulating material a complex of film-forming hydrophilic polymeric materials. Other hydrophobic materials include butadiene-styrene containing resins, acrylic resins, urethanes, fluorocarbons, polyethylene, polyvinylidene chloride and regenerated cellulose. Suitable methods for forming the capsules are described, by way of example, in U.S. Pat. Nos. 2,800,457; 2,800,458; and 2,907,682. The disclosures of these patents are incorporated herein by reference. One illustrative method of making minute or microscopic capsules of film-forming hydrophilic polymeric material containing an acid catalyst comprises making an aqueous sol of a hydrophilic polymeric material, e.g., gelatin, and emulsifying therein a water-immiscible organic liquid, in which the acid catalyst is suspended until the required microscopic drop size is obtained, and diluting the emulsion with water or an acidified aqueous solution in such amount as to cause the hydrophilic polymeric material to deposit around each microscopic drop of acid. All of the steps are carried out at a temperature above the gelation or solidification point of the polymeric material. In the case of gelatin, the temperature during these steps is maintained at 50° C. or above. Gelation or solidification of the encapsulating material is then achieved by cooling to a temperature below the gelation or solidification point of the material. If this latter step is performed rapidly, as by rapid cooling, the pore size of the resulting capsules will be small. Whereas the particle size of the capsules is not particularly critical, a preferred range of particle size is 0.5–30 microns depending upon the particular coating and calendering equipment employed.

Also of interest is the process disclosed in U.S. Pat. No. 3,523,906 useful in the encapsulation of water soluble or dispersible compounds, for instance water soluble or dispersible cross-linking agents or accelerator acids of the present invention. In the process of this patent, a preformed film-forming hydrophobic polymeric material soluble in a water-immiscible solvent is used to encapsulate the water soluble or dispersible member. This is carried out by first forming a solution of the hydrophobic polymeric material in the solvent, the latter having a boiling point below about 100° C. The water soluble or dispersible member, in water, is then emulsified with the film-forming polymeric material and solvent, and this emulsion is then emulsified in an aqueous solution of a hydrophilic colloid. Following this, the solvent for the polymeric material is removed by evaporation. Variations of this process are shown in U.S. Pat. Nos. 3,523,907 and 3,645,911.

In the application of coatings, a wide variety of processes can be employed depending upon the use of paper intended. For instance, the coating material may be applied in a molten condition, in solution, in suspension, or as an emulsion depending upon the physical form of the resin or solution and the characteristics of the paper being coated. Solvent systems permit the formulation of highly sophisticated coatings incorporating a wide variety of polymers and various modifiers.

Types of coating equipment include conventional roll coaters, "air doctor" coaters, trailing blade coaters, cast coating equipment, reverse roll coaters, and size press coaters.

Any suitable calendering equipment on the market today can be employed in the process of the present invention. Suitable such calendering equipment include both steel-to-steel and steel-to-cotton rolls.

EXAMPLE I

A sheet of 40 pounds per ream of bleached kraft paper is coated to provide a pigmented coat in a conventional blade coater with the following composition:

| Ingredients | Parts by Weight |
|---|---|
| Pigment clay, #1 coating clay | 1000 |
| Latex Dow 620 (50% solids) | |

-continued

| Ingredients | Parts by Weight |
|---|---|
| butadiene-styrene copolymer modified to contain acrylic groups | 200 |
| Starch | 50 |
| Urea formaldehyde curing resin (dry) | 7.5 |
| Acid accelerator (encapsulated) (dry) | .5 |

The acid accelerator is encapsulated by any of the procedures of the prior art, for instance that disclosed in prior U.S. Pat. No. 3,886,084.

The paper picks up approximately 10 pounds per ream of coating material. The coated paper is dried to coalesce the latex binder and then is calendered in a 6 roll calender having a calender pressure of about 250 psi.

Following calendering, cure takes place within minutes to yield a water resistant, smooth coating surface.

What is claimed is:

1. A method for the preparation of coated paper having a cured binder coating comprising the steps of
   applying to said paper a coating formulation comprising on a dry basis at least about 5% by weight of a reactive polymer having reactive carboxyl, hydroxyl or amido groups, an aminoplast cross-linking agent and a curing accelerator catalyst wherein either or both the accelerator and cross-linking agent are encapsulated in microcapsules;
   the amount of cross-linking agent being in the range of about 1:50–1:2 based on the weight of reactive polymer;
   the amount of accelerator catalyst being in the range of about 0.1:100–3:100 based on the weight of reactive polymer;
   subjecting said paper to the successive steps of drying and calendering;
   said microcapsules being ruptured in the calendering step to achieve a controlled cure of the binder coating in such step.

2. A method for the preparation of coated paper having a cured binder coating comprising the steps of
   applying to said paper a coating formulation comprising on a dry basis at least about 5% by weight of a reactive polymer, a cross-linking agent and a curing accelerator wherein either or both the accelerator and cross-linking agent are encapsulated in microcapsules;
   the amount of cross-linking agent being in the range of about 1:50–1:2 based on the weight of reactive polymer;
   the amount of accelerator catalyst being in the range of about 0.1:100–3:100 based on the weight of reactive polymer;
   subjecting said paper to the successive steps of drying and calendering;
   said microcapsules being ruptured in the calendering step to achieve a controlled cure of the binder coating in such step.

3. The method of claim 1 wherein said encapsulation is carried out by coacervation.

4. The method of claim 3 wherein said reactive polymer is a compound selected from the group consisting of casein, soy or alpha protein, starch, polyvinyl alcohol, alcohol or carboxylic acid functional polyesters, epoxide resins, and acrylic and methacrylic acid resins.

5. The method of claim 4 wherein said coating formulation is water based, the encapsulating material being a hydrophobic, film-forming, polymeric material.

6. The method of claim 1 for a pigmented coating wherein the coating formulation comprises about 5–50% by weight reactive polymer based on the weight of pigment.

7. The method of claim 1 wherein the ratio of cross-linking agent to reactive polymer is between about 1:10 and about 1:4.

8. The method of claim 6 wherein said coating formulation is for a pigment-containing coating, said coating formulation comprising
   reactive polymer based on pigment content — 5–50%
   cross-linking agent based on polymer content — 2–20%
   curing accelerator based on cross-linking agent content — 0.1–10%.

9. The method of claim 6 wherein said coating formulation is for a pigment-containing barrier coating, the reactive polymer comprising a styrene-butadiene copolymer latex modified to contain acrylic groups.

10. The method of claim 9 wherein the coating formulation comprises about 30% reactive polymer based on pigment content, about 10% cross-linking agent based on polymer content, and about 1% curing accelerator based on cross-linking agent content.

11. The method of claim 6 wherein said paper is coated printing paper, the reactive polymer comprising a styrene-butadiene latex modified to include carboxyl groups.

12. The method of claim 11 wherein said formulation comprises about 14% reactive polymer based on pigment content, about 5% cross-linking agent based on reactive polymer content, and about 0.25% curing accelerator based on cross-linking agent content.

13. The method of claim 3 wherein the microcapsules have a particle size range between about 0.5–30 microns.

14. The method according to claim 1 wherein said coating is a pigmented coating, said coating formulation comprising

| | Parts by Weight |
|---|---|
| Pigment clay, #1 coating clay | 1000 |
| Latex Dow 620 (50% solids) butadiene-styrene copolymer modified to contain acrylic groups | 200 |
| Starch | 50 |
| Urea formaldehyde curing resin (dry) | 7.5 |
| Acid accelerator (encapsulated) (dry) | .5. |

15. The process of claim 1 wherein said cross-linking agent is an aldehyde or aldehyde amine resin, said polymer being selected from the group consisting of starch, protein, casein and synthetic carboxylated polymers.

16. A paper coated according to the method of claim 3.

* * * * *